US010431040B2

(12) United States Patent
Sotiriou et al.

(10) Patent No.: US 10,431,040 B2
(45) Date of Patent: Oct. 1, 2019

(54) EVENTS AGENT FOR SERVER-SUPPLIED WAGERING GAMING

(71) Applicant: IGT UK Interactive Limited, London (GB)

(72) Inventors: Athanasios-Dimitrios Sotiriou, London (GB); Lorenzo Repichini, Rome (IT); Bryan Upton, Hemel Hempstead (GB); Damiano Turchi, Rome (IT)

(73) Assignee: IGT UK Interactive Limited, London (GB)

( * ) Notice: Subject to any disclaimer, the term of this patent is extended or adjusted under 35 U.S.C. 154(b) by 228 days.

(21) Appl. No.: 14/884,736

(22) Filed: Oct. 15, 2015

(65) Prior Publication Data

US 2016/0110953 A1 Apr. 21, 2016

Related U.S. Application Data

(60) Provisional application No. 62/122,247, filed on Oct. 15, 2014.

(51) Int. Cl.
*G07F 17/32* (2006.01)

(52) U.S. Cl.
CPC ..... *G07F 17/3225* (2013.01); *G07F 17/3227* (2013.01); *G07F 17/3244* (2013.01)

(58) Field of Classification Search
None
See application file for complete search history.

(56) References Cited

U.S. PATENT DOCUMENTS

2007/0191111 A1* 8/2007 Sylla ..... G07F 17/32 463/43
2007/0243934 A1* 10/2007 Little ..... G07F 17/32 463/40
2010/0099491 A1* 4/2010 Little ..... G07F 17/32 463/29
2011/0183762 A1* 7/2011 Topham ..... G07F 17/32 463/42
2012/0264504 A1* 10/2012 Gagner ..... G07F 17/323 463/25
2016/0098894 A1* 4/2016 Kelly ..... G07F 17/3223 463/25

* cited by examiner

*Primary Examiner* — James S. McClellan
*Assistant Examiner* — Peter J Iannuzzi
(74) *Attorney, Agent, or Firm* — Sage Patent Group

(57) ABSTRACT

An events agent core library of software functions, when executed by at least one processor of a client device, receives notifications of in-game events from game content software downloaded to the client device from a game supplier server and executing on the client device providing wagering game play to a user of the client device. Based on the notifications, the events agent core may report at least some of the in-game events to a front-end set of processor-executable instructions downloaded to the client device from a gaming operator server different from the game supplier server, the front-end set of processor-executable instructions being configured to cause the at least one processor of the client device to implement an out-of-game response based on at least one of the reported in-game events.

15 Claims, 11 Drawing Sheets

EVENTS AGENT FOR SERVER-SUPPLIED WAGERING GAMING

CROSS-REFERENCE TO RELATED APPLICATIONS

This application claims a priority benefit under 35 U.S.C. § 119(e) to U.S. Provisional Patent Application Ser. No. 62/122,247, filed Oct. 15, 2014, entitled Events Software Middleware for Online Gambling Games, which is incorporated herein by reference in its entirety.

BACKGROUND

Online wagering gaming has become increasingly popular, as players connect their personal computing devices to the Internet to access and play wagering games. Typically, the gaming is hosted on a website owned by an Operator who holds a license from the applicable government (if such a license is necessary in the Operator's jurisdiction) to host wagering game play online. The Operator typically maintains for its users monetary accounts established for funding game play in any of the wagering games that the Operator hosts. A player can add funds to his online account with the Operator by any of various methods, and then use those funds to place wagers in any of the Operator's hosted games that the player chooses to play. If the player achieves any winnings in a hosted online game, the Operator may credit those winnings to the player's account, or may disburse the money to the user in some other way.

When a player selects an online wagering game to play via an Operator's site, typically a communication is sent from the player's computing device to the Operator's server hosting the website, indicating the requested game that the player would like to play. In response, the Operator server delivers to the player's web browser a link to download the game content software for the requested game from a game supplier server, often referred to as a remote game server (RGS). The game supplier server often is owned and/or operated by a game supplier who is a different entity (e.g., a different corporation or other type of company) from the gaming website Operator, and who develops and/or supplies the game content software that, when executed on the player's device, provides the game play of a particular wagering game. Any of a variety of wagering games may be provided by game suppliers for online gaming, including some that mimic wagering games traditionally hosted in brick-and-mortar casinos, such as reel-spinning (slot machine) games, wagering card games (e.g., poker, blackjack, etc.), roulette, arcade games, etc. A player who has an account with a wagering gaming Operator can typically select from a menu of the games hosted by that Operator, to be enabled to download the game content software for the particular selected game from that game's RGS. The downloaded game content software can then be executed on the player's device to play the wagering game.

SUMMARY

One type of embodiment is directed to a wagering gaming system comprising: a game supplier server configured to provide game content software providing wagering game play; a back-end events analysis server; and a wagering gaming operator server, different from the game supplier server, configured to: receive from a client device a request for the game content software to provide wagering game play to a user of the client device; in response to the request, enable the client device to download the requested game content software from the game supplier server; and transmit to the client device, from the wagering gaming operator server, an events agent core library of software functions and a set of front-end software functions; wherein the events agent core library, when executed by the client device, performs functionality comprising: receiving notifications of in-game events from the downloaded game content software executing on the client device; and based on the notifications, reporting at least some of the in-game events to the front-end software functions, and reporting at least some of the in-game events to the back-end analysis server; wherein the front-end software functions, when executed by the client device, perform functionality comprising implementing an out-of-game response based on at least one of the reported in-game events; wherein the back-end events analysis server is configured to: aggregate the reported in-game events from a plurality of wagering games at the back-end events analysis server; and provide to the game supplier server, from the back-end events analysis server, analytics based on the aggregated in-game events; and wherein the game supplier server is configured to perform alterations on the game content software for transmission to the client device in response to the analytics from the back-end events analysis server.

Another type of embodiment is directed to at least one non-transitory processor-readable storage medium storing processor-executable instructions that, when executed by at least one processor of a client device, perform functionality comprising: receiving notifications of in-game events from game content software downloaded to the client device from a game supplier server and executing on the client device providing wagering game play to a user of the client device; and based on the notifications, reporting at least some of the in-game events to a front-end set of processor-executable instructions downloaded to the client device from a gaming operator server different from the game supplier server, the front-end set of processor-executable instructions being configured to cause the at least one processor of the client device to implement an out-of-game response based on at least one of the reported in-game events.

Another type of embodiment is directed to a wagering gaming operator server, comprising: at least one processor; and at least one storage medium storing processor-executable instructions that, when executed by the at least one processor, cause the at least one processor to perform: receiving, from a client device, a request for game content software to provide wagering game play to a user of the client device; in response to the request, enabling the client device to download the requested game content software from a game supplier server different from the wagering gaming operator server; and transmitting to the client device, from the wagering gaming operator server, an events agent core library of software functions and a set of front-end software functions; wherein the events agent core library, when executed by the client device, performs functionality comprising: receiving notifications of in-game events from the downloaded game content software executing on the client device; and based on the notifications, reporting at least some of the in-game events to the front-end software functions; and wherein the front-end software functions, when executed by the client device, perform functionality comprising implementing an out-of-game response based on at least one of the reported in-game events.

Another type of embodiment is directed to a wagering gaming operator server, comprising: at least one processor;

and at least one storage medium storing processor-executable instructions that, when executed by the at least one processor, cause the at least one processor to perform: receiving, from a client device, a request for game content software to provide wagering game play to a user of the client device; in response to the request, enabling the client device to download the requested game content software from a game supplier server different from the wagering gaming operator server; and transmitting to the client device, from the wagering gaming operator server, an events agent core library of software functions that, when executed by the client device, performs functionality comprising: receiving notifications of in-game events from the downloaded game content software executing on the client device; and based on the notifications, reporting at least some of the in-game events to a back-end analysis server, different from the game supplier server, that is configured to aggregate the reported in-game events from a plurality of wagering games, and provide analytics based on the aggregated in-game events to the game supplier server, wherein the game supplier server is configured to perform alterations on the game content software for transmission to the client device in response to the analytics.

Another type of embodiment is directed to a method of facilitating feedback adaptation in a wagering gaming system, the method comprising: providing a back-end events analysis server configured to communicate with a game supplier server, the game supplier server being configured to transmit game content software to a client device to provide wagering game play to a user of the client device; providing to the client device, via a server different from the game supplier server, an events agent core library of software functions that, when executed by the client device, performs functionality comprising: receiving notifications of in-game events from the downloaded game content software executing on the client device, and based on the notifications, reporting at least some of the in-game events to the back-end analysis server; aggregating the reported in-game events from a plurality of wagering games at the back-end events analysis server; and providing to the game supplier server, from the back-end events analysis server, analytics based on the aggregated in-game events, wherein the game supplier server is configured to perform alterations on the game content software for transmission to the client device in response to the analytics from the back-end events analysis server.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
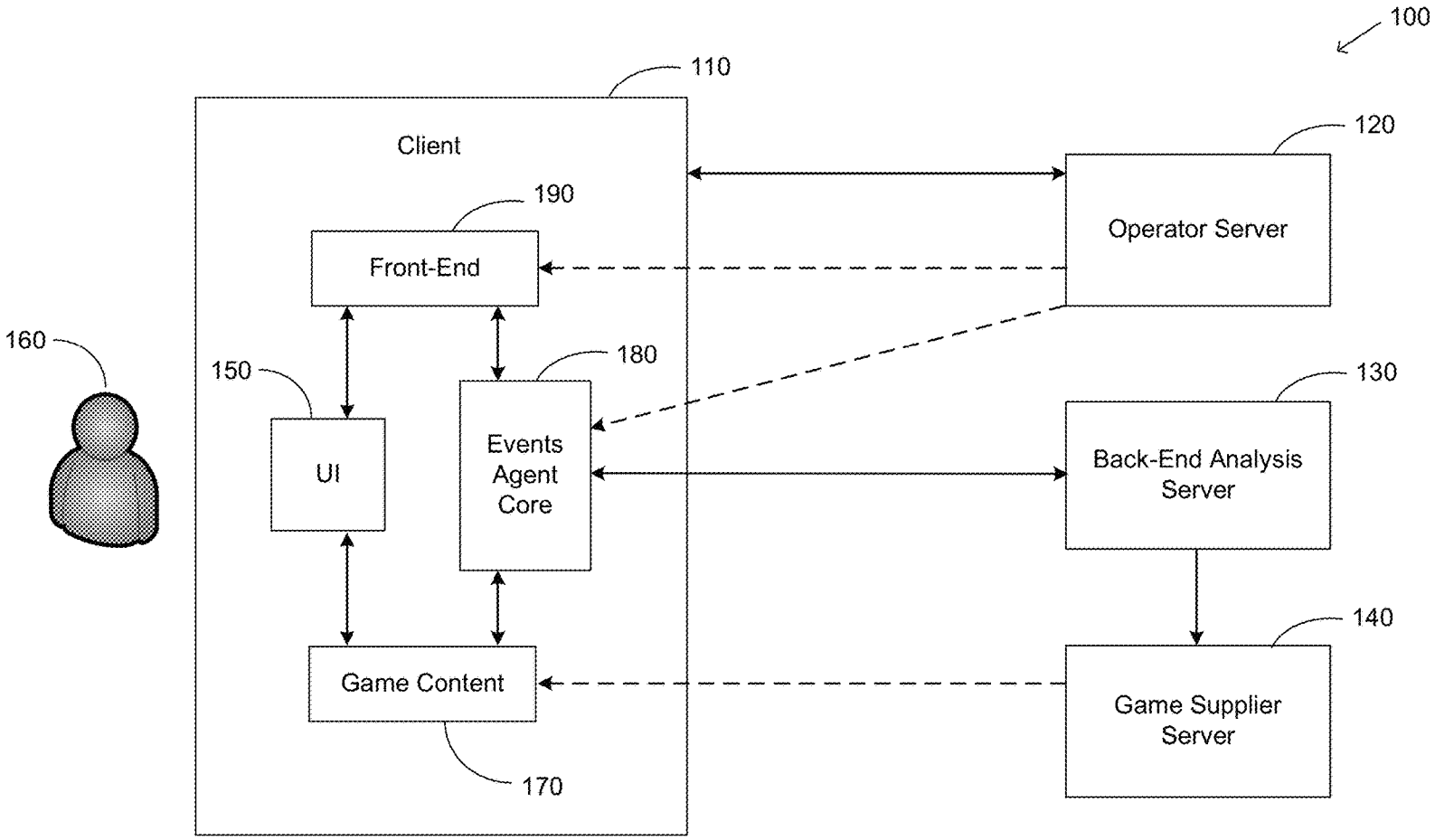
FIG. 1 illustrates an exemplary wagering gaming system in accordance with some embodiments.

The inventors have appreciated that players of online wagering games may conventionally encounter multiple different, inconsistent interfaces when playing wagering games online, even when using a single Operator's website as a portal to the wagering games. For example, when the Operator provides a player with access to multiple wagering games provided by third-party game suppliers, each different game may be configured to provide common types of information such as information on the player's balances, wager amounts, settings, error messages, etc., in a different way (e.g., displayed in a different part of the computer screen, in a different font, size and/or color, with different message text and/or format, with different associated sounds, etc.), which may be confusing to the player. The inventors have further recognized that some Operators may wish to provide players with information, promotions, and/or other out-of-game responses via software code external to the game content, and may wish to base these out-of-game responses on events that occur within the game. For example, the Operator may wish to display a real-time balance of the user's monetary account with the online casino, updated based on any wins and/or losses in the wagering game currently being played, or may wish to provide an out-of-game response, such as a promotion, in real time in response to the occurrence of a particular event in the game, such as the triggering of a bonus. This has not conventionally been possible with third-party-supplied games, because the out-of-game components supplied by the Operator do not have visibility into events occurring within the game content downloaded from the third-party game supplier.

The inventors have therefore developed an events agent framework that may allow in some embodiments for out-of-game Operator responses on a user's client device to be based on in-game events occurring as part of the game play executed by the game content software. The events agent may allow for the game content and external out-of-game components to remain decoupled, while providing a messaging protocol that defines a standardized format and routing for event notifications. In some embodiments, game content software may provide notifications of in-game events to the events agent while remaining agnostic to the Operator-supplied front-end, which may provide out-of-game responses to the in-game events based on relevant notifications delivered by the events agent.

Accordingly, some embodiments described herein relate to wagering gaming systems that may address one or more of the above-discussed shortcomings of traditional methods, and/or that may provide one or more of the foregoing benefits. However, embodiments are not limited to any of these benefits, and it should be appreciated that some embodiments may not provide any of the above-discussed benefits and/or may not address any of the above-discussed deficiencies that the inventors have recognized in conventional techniques.

In some embodiments, a player (user) may operate a client device to transmit a request for game content software to a wagering gaming operator server. For example, the player may select a particular game from a menu of games hosted by the operator. In response, the operator server may enable the client device to download the requested game content software from a game supplier server different from the operator server. For example, the operator server may transmit to the client device a hyperlink enabling the client device to download the game content software over the Internet from the game supplier server. The game content software may provide wagering game play to the player by executing on the client device.

In some embodiments, the operator server may also transmit to the client device an events agent core library of software functions that, when executed by the client device, receives notification of in-game events from the game content software executing on the client device. In some embodiments, anything that happens in the course of a game's execution, and/or any current state of the game, can be reported as an event, by configuring a notification message according to a designated protocol for the events agent. Operators, back-end analysis providers, and/or any other suitable party may specify events of interest which game suppliers may configure game content software to report, and/or game suppliers may decide which events to report, which operators and/or other parties may make use of. Examples of suitable in-game events and reporting are described below.

In some embodiments, the operator server may also transmit to the client device a set of front-end software functions that, when executed by the client device, implement one or more out-of-game responses based on one or more in-game events reported via the events agent core. In some embodiments, an out-of-game response may relate an in-game event to something external to the game, such as something having applicability to multiple games that have been or could be played by the player via the operator host. For example, an out-of-game response may display information derived from events notifications from multiple wagering games, such as the player's combined winnings across games, or the player's account balance with the operator (which is established for funding game play in any of multiple wagering games hosted by the operator), etc. In another example, an out-of-game response may prompt the user to perform an out-of-game action, such as adding funds to the account, or making another purchase, etc.

In some embodiments, alternatively or additionally, the events agent core may report at least some of the in-game events from the game content software to a back-end analysis server different from the game supplier server. In some embodiments, the back-end analysis server may be configured to aggregate the reported in-game events from multiple wagering games for the same player, and/or for multiple different players, and may provide analytics based on the aggregated in-game events to the game supplier server. The game supplier server, in some embodiments, may be configured to perform alterations on the game content software for transmission to the client device in response to the analytics. For example, the analytics based on events from multiple games may reveal information about the level of skill of the player, and the game content software may be adjusted to make the game play easier or more difficult to tailor it to the player's skill. In another example, the analytics may reveal that the player tends to stop playing a game after a particular type of event occurs, and the game content software may be adjusted in response to avoid that type of event to keep the player more interested.

It should be appreciated that the foregoing description is by way of example only, and some embodiments are not limited to providing any or all of the above-described functionality, although some embodiments may provide some or all of the functionality described herein.

The techniques described herein can be implemented in any of numerous ways, and are not limited to any particular implementation techniques. Thus, while examples of specific implementation techniques are described below, it should be appreciated that the examples are provided merely for purposes of illustration, and that other implementations are possible.

One illustrative application for techniques described herein is for use in a wagering gaming system. An example of such a system 100 is illustrated in FIG. 1. The exemplary system includes an operator server 120, a back-end analysis server 130, and a game supplier server 140, each of which is configured to communicate with a client device 110. The exemplary components of system 100 may be implemented in any suitable form, as embodiments are not limited in this respect. For example, each of servers 120, 130, and 140 may be implemented as a single stand-alone machine, or may be implemented by multiple distributed machines that share processing tasks in any suitable manner. Servers 120, 130, and 140, and client device 110, may each be implemented as one or more computers; an example of a suitable computer is described below. In some embodiments, each computing device may include one or more tangible, non-transitory processor-readable storage devices storing processor-executable instructions, and one or more processors that execute the processor-executable instructions to perform the functions described herein. The storage devices may be implemented as computer-readable storage media (i.e., tangible, non-transitory computer-readable media) encoded with the processor-executable instructions; examples of suitable computer-readable storage media are discussed below. In some embodiments, each of servers 120, 130, and 140 may be a separate physical device, and in some embodiments the servers may be in different locations remote from each other, while in other embodiments, any one or more of servers 120, 130, and 140 may be implemented as separate virtual servers running on shared physical hardware. In some embodiments, each of servers 120, 130, and 140 may be owned and/or operated by a different (corporate) entity. In other embodiments, any one or more of servers 120, 130, and 140 may be owned and/or operated by a common entity, but may be maintained as separate (physical or virtual) servers.

Servers 120, 130, and 140 may communicate with client device 110 (and, when implemented on separate physical devices) via any suitable network connection(s), such as one or more wired and/or wireless network connections, local area networks, wide area networks, cellular networks, and/or the Internet. In some online gaming embodiments, the functionality described herein as being implemented on or executed via the client device may performed by a web browser executing software code (e.g., webpage files and/or scripts), which may be downloaded to the client browser over the Internet from, e.g., servers 120 and 140. In some casino gaming embodiments, client device 110 may be a casino game machine in a brick-and-mortar casino; an example of a casino game machine on which electronic wagering games such as reel-spinning games may be played is described below. In some such embodiments, any or all of servers 120, 130, and 140 may be central servers of the casino establishment, and may transmit software code to and receive communications from the casino game machine client device 110 via one or more networks local to the casino. Other implementations of client device 110 are also possible, such as a video lottery terminal in a brick-and-mortar establishment, or any other suitable client device to which game content software is downloaded for playing wagering games.

In some embodiments, operator server 120 may be configured to host wagering games and to provide players with access to the games hosted by the operator. For example, in some online gaming embodiments, operator server 120 may host a website providing a portal to multiple wagering games as an online casino. A player 160 may operate client device 110 (e.g., a web browser executing on client device 110) to navigate to the website hosted by operator server 120 and select a particular hosted wagering game to play. This may be done in any suitable way. For example, in some embodiments, the operator's website may provide a menu of available games from which the player 160 may select, and the client device web browser may transmit the player's selection to operator server 120 as a request for the game content software corresponding to the selected game. In response to the request, operator server 120 may enable client device 110 to download the requested game content software 170 from game supplier server 140, in any suitable way. For example, in some embodiments, operator server 120 may provide a web address (e.g., a URL) to which the web browser of client device 110 may navigate to retrieve and download game content software 170 from game supplier server 140. The downloaded game content software 170 may be executed by the client device 110 to provide wagering game play to the user 160 of the client device 110, e.g., via user interface (UI) component 150 of client device 110. For example, game content software 170 may implement a reel-spinning game, a card game, a roulette game, an arcade game, or another type of wagering game, and player 160 may interact with (e.g., provide input to and receive responsive output from) game content software 170 (e.g., via UI 150) to play the game. Game content software 170 may be implemented in any suitable form; for example, game content software 170 may be implemented as code in Flash, HTML5, C++, or any other suitable programming language.

In some embodiments, whereas game content software 170 may be downloaded to client device 110 from game supplier server 140, operator server 120 may itself transmit to client device 110 an events agent core library of software functions 180 that may be executed by client device 110 (e.g., by the web browser of client device 110 that also executes game content software 170). The events agent core 180 may likewise be implemented in any suitable form; in some exemplary embodiments, events agent core 180 may be implemented as a set of JavaScript APIs. In some embodiments, events agent core 180 may be configured to receive notifications of in-game events from game content software 170 as game content software 170 is executing on client device 110 and player 160 is thereby playing the wagering game. In some embodiments, an in-game event notification may include notification of a state of the wagering game being played. Any suitable set of events may be reported, as embodiments are not limited to any particular set of defined events. An exemplary list of suitable in-game events is provided below; however, it should be appreciated that this list is merely an example. Some embodiments may utilize only some or none of the event types in this exemplary list, and/or may utilize additional event types not appearing in the list below.

| Category | Event |
|---|---|
| Options | VolumeChange |
| | AudioToggle |
| | PaytableToggle |
| | PaytablePageSwitch |
| | OptionsToggle |
| | OptionsChange |
| | FullScreenToggle |
| | ScreenResize |
| | Help |
| | Keyboard shortcut |
| | Replay mode |
| Generic | GameError |
| | GameReady |
| | GameLoading |
| | GameLoaded |
| | GameClose |
| Account | BalanceChanged |
| | BetChange |
| | MaxBet |
| | ChipChange |
| | ClearBet |
| | Stake |
| | Outcome |
| | Deposit |
| Actions | AutoPlayStarted |
| | AutoPlayStopped |
| | AutoPlayNextRound |
| | Play |
| | Sidebet |
| | Gamble |
| | GenericAction |
| Animation | AnimationStarted |
| | AnimationComplete |
| | StartAnimationControl |
| | StopAnimationControl |
| | Skip |
| Games | BonusGameStarted |
| | BonusGameComplete |
| Table games | Sit out |
| | Favorite Bet Saved |
| | Frequent Betting |
| | Bet Type |
| Slots | WinLines |
| Additional | Heatmap |
| | Screenshot |

In some embodiments, operator server 120 may also transmit to client device 110 a set of front-end software functions 190 which may be executed by client device 110 (e.g., by the web browser), and to which events agent core 180 may report at least some of the in-game events based on the notifications received from game content software 170. The set of front-end software functions 190 may be implemented in any suitable form; in some exemplary embodiments, the set of front-end software functions 190 may be implemented in JavaScript and/or HTML5. Any suitable process may be used by events agent core 180 to determine which in-game events to report to front-end 190. For example, in some embodiments, the operator may design front-end 190 to utilize a particular set of events and to communicate this set to events agent core 180, which may then report events according to the set designated by front-end 190. Alternatively or additionally, in some embodiments events agent core 180 may be configured to report some events by default, and front-end 190 may configured to utilize or ignore any of the default reported events.

In some embodiments, front-end 190 may implement one or more out-of-game responses (e.g., via UI 150) based on one or more in-game events reported by events agent core 180. Any suitable out-of-game response(s) may be designed for execution via front-end 190 in response to any suitable in-game event(s). As an example, in some embodiments, an out-of-game response may include displaying to player 160 information derived from event notifications from multiple wagering games. For example, front-end 190 may implement an out-of-game response to display, via UI 150, the player's cumulative winnings over multiple games in response to an in-game event notification of a current win, and/or to display an updated balance of the player's monetary account with the operator which is established for funding game play in multiple wagering games hosted by the operator. As another example, in some embodiments, an out-of-game response may include prompting player 160, based on the state of the wagering game as reported in an in-game event notification, to take an action directed to the player's monetary account. For example, in some embodiments, the player may be prompted to add funds to the monetary account at times when in-game event notifications reveal that the player has reached a state of game play during which players are more likely to feel good about spending more money on further wagering, such as when a bonus has been triggered in the current wagering game. Other examples may include providing promotional advertisements at times when in-game event notifications reveal that the game play is in a state in which the player is likely to be receptive to such promotions. Another example of an out-of-game response may be an instruction provided by the front-end to the game content software via the events agent core, to launch an in-game bonus round based on an out-of-game event.

In some embodiments, alternatively or additionally to reporting in-game events to a front-end 190, events agent core 180 may be configured to report at least some of the in-game events to back-end analysis server 130 based on the notifications from game content software 170. Back-end analysis server 130 may be configured to aggregate the reported in-game events from multiple wagering games for player 160, and/or for multiple players including player 160, and in some embodiments these aggregated reported events may be used for data mining for any suitable purposes, such as, e.g., user segmentation, game recommendations tailored to the player, analysis of game behavior, analysis of the most suitable areas to put player input, analysis of preferred in-game option settings, player wagering analysis, etc. Alternatively or additionally, in some embodiments back-end analysis server 130 may provide analytics based on the aggregated in-game events to game supplier server 140, which may perform alterations on the game content software 170 for transmission to client device 110 in response to the analytics. In some embodiments, this type of feedback adaptation may occur as the user is playing a current wagering game. For example, in some embodiments, the alterations to game content software 170 from game supplier server 140 may include triggering one or more in-game events based on the analytics provided from back-end analysis server 130. For instance, such alterations may include causing a bonus round to be launched after the end of the main game, offering a bonus to the player by animating a win, etc. As another example, in some embodiments, alterations may include modifying one or more probabilities used in the chance components of the game content software 170 in providing the wagering game play to the player 160. The functionality of back-end analysis server 130 may be implemented in any suitable way. In some exemplary embodiments, back-end functionality may be implemented as software code in the Java programming language.

Figure 2:
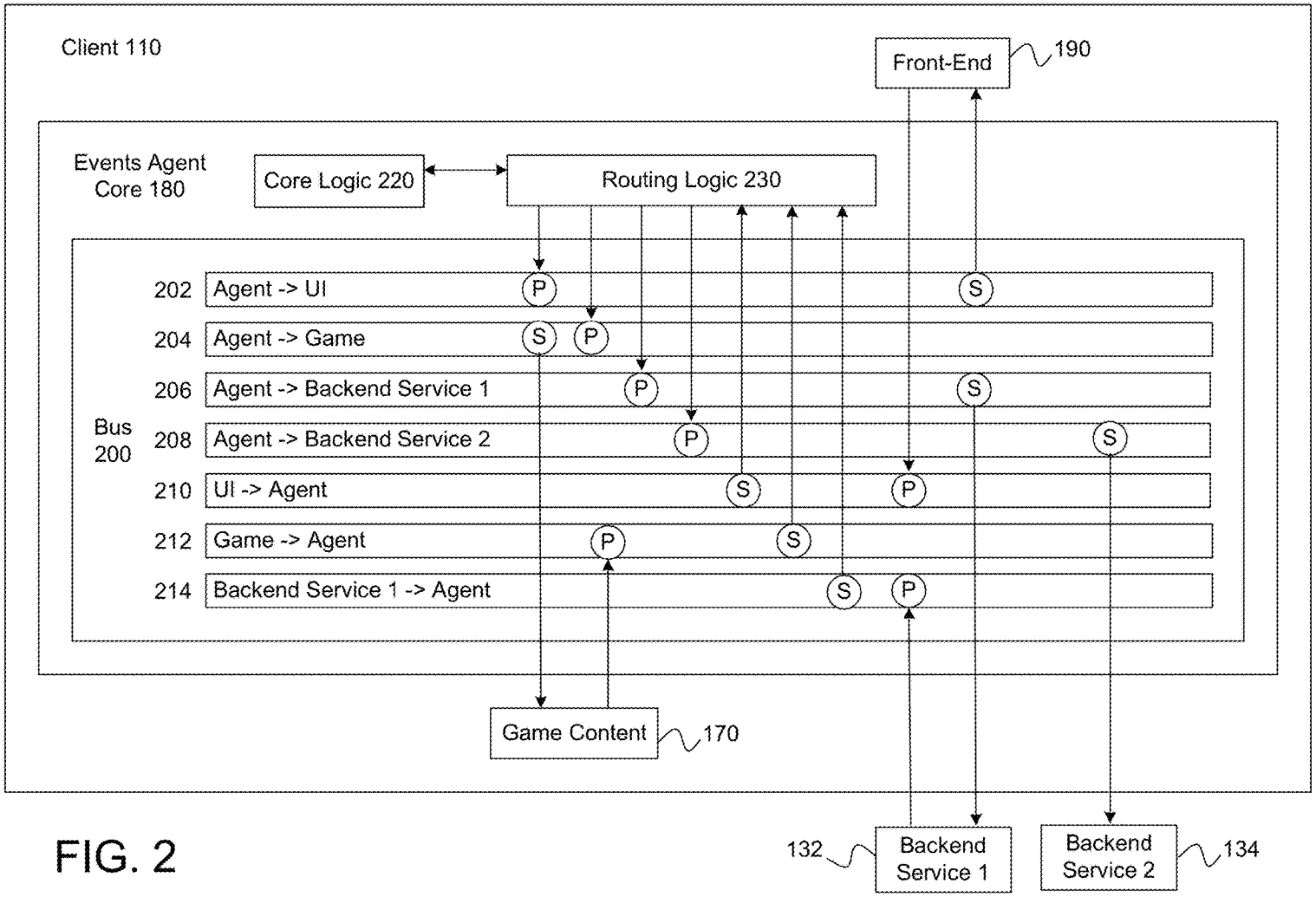
FIG. 2 illustrates an exemplary message bus in accordance with some embodiments.

Event notifications, as described above, may be implemented in any suitable form. In some embodiments, event notifications may be configured in standard formats understandable to the events agent core 180, which formats may be known and utilized by game suppliers and operators when configuring game content software 170 and front-end software 190 to receive and report events. In one exemplary implementation, event notifications may be configured as JSON objects. In some exemplary embodiments, events agent core 180 may be configured to implement a message bus with a publish/subscribe protocol; FIG. 2 illustrates one exemplary configuration of such a message bus 200. Exemplary message bus 200 includes seven topics 202-214. A software component (e.g., such as game content software 170 and/or front-end 190) can publish an event notification on a topic by conforming the event notification message to a particular format specified for that topic. Likewise, a software component can subscribe to event notifications on a topic by scanning the message bus for messages in the specified format for that topic. This is merely one example; other configurations of a publish/subscribe system are also possible.

In the exemplary implementation of FIG. 2, routing logic 230 interfaces with core logic 220 of events agent core 180 to identify received event notifications based on their topics in message bus 200 and to publish events on the appropriate topics for reporting to other components of the system. Agent→UI topic 202 is used for events agent core 180 to report in-game events to front-end 190, and is published on by core logic 220 (via routing logic 230) and subscribed to by front-end 190. Agent→Game topic 204 is used for events agent core 180 to report events (e.g., as received from front-end 190 and/or from back-end analysis server 130) to game content software 170, and is published on by core logic 220 (via routing logic 230) and subscribed to by game content software 170 Agent→Backend Service 1 topic 206 is used for events agent core 180 to report events to a first service on back-end analysis server 130 that both receives events from and reports events to events agent core 180. Agent→Backend Service 1 topic 206 is published on by core logic 220 (via routing logic 230) and subscribed to by backend service 1 (132). Agent→Backend Service 2 topic 208 is used for events agent core 180 to report events to a second service on back-end analysis server 130 that only receives events from events agent core 180 (e.g., to aggregate them). Agent→Backend Service 2 topic 208 is published on by core logic 220 (via routing logic 230) and subscribed to by backend service 2 (134). UI→Agent topic 210 is used for front-end 190 to report events (such as user input) to events agent core 180, and is published on by front-end 190 and subscribed to by core logic 220 (via routing logic 230). Game→Agent topic 212 is used for game content software 170 to deliver in-game event notifications to events agent core 180, and is published on by game content software 170 and subscribed to by core logic 220 (via routing logic 230). Finally, Backend Service 1→Agent topic 214 is used for the first service on back-end analysis server 130 to report events to events agent core 180, and is published on by backend service 1 (132) and subscribed to by core logic 220 (via routing logic 230). It should be appreciated, however, that the above description regarding exemplary message bus 200 is provided merely for purposes of illustration and is not intended to be limiting.

Figure 3A:
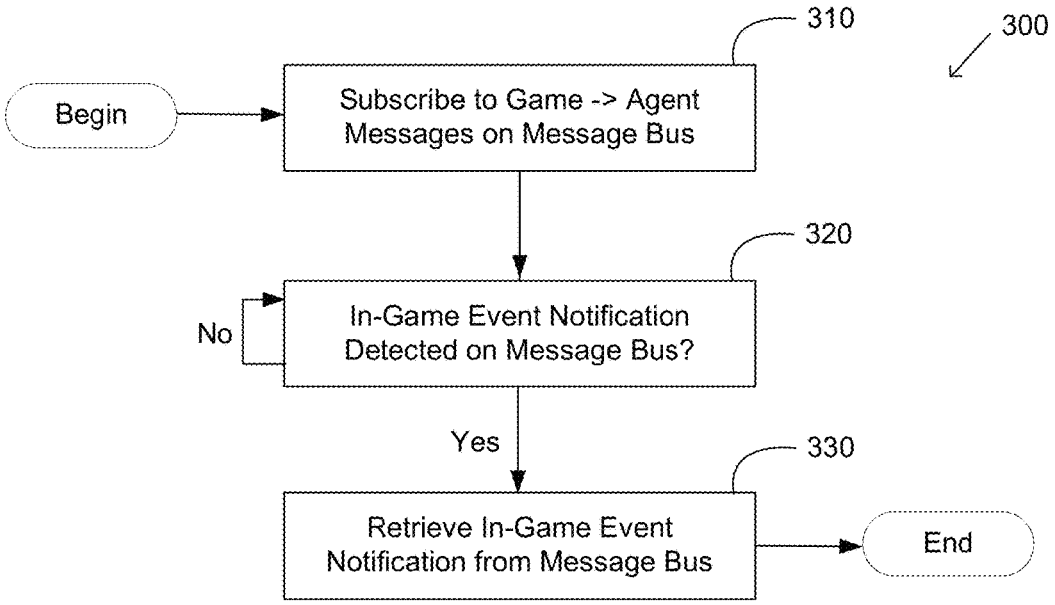
FIG. 3A illustrates an exemplary algorithm for receiving notifications of in-game events in accordance with some embodiments.

FIG. 3A illustrates a non-limiting exemplary algorithm 300 suitable for an events agent core to receive notifications of in-game events from game content software. At act 310, the events agent core may subscribe to Game→Agent messages on a message bus (e.g., topic 212 in bus 200 of FIG. 2). At act 320, the events agent core may make a determination whether an in-game event notification from the game content software is detected on the message bus. Act 320 may loop while no event notification is detected, and then may proceed to act 330 when an event notification is detected on the message bus. At act 330, the detected in-game event notification may be retrieved from the message bus.

Figure 3B:
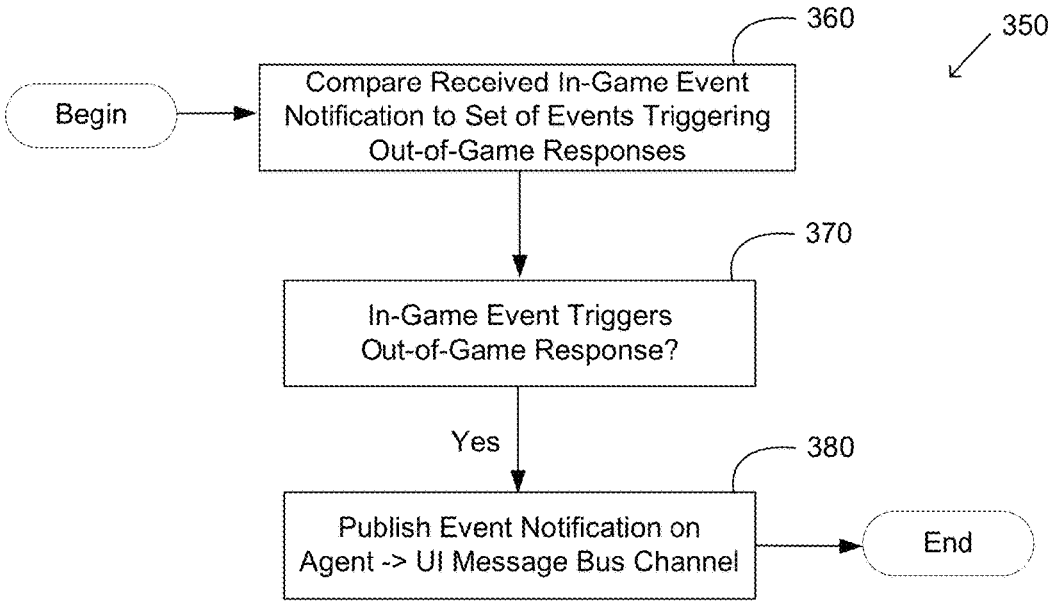
FIG. 3B illustrates an exemplary algorithm for reporting in-game events to a front-end in accordance with some embodiments.

FIG. 3B illustrates a non-limiting exemplary algorithm 350 suitable for an events agent core to report at least some of the in-game events to a set of front-end software functions, based on the notifications from the game content software. At act 360, the events agent core may compare a received in-game event notification to a set of events (e.g., specified in a table or list) that are known to be useful in triggering out-of-game responses. At act 370, the events agent core may determine based on the comparison whether the received in-game event triggers an out-of-game response. At act 380, if the in-game event is one of the set specified as triggering an out-of-game response, then the events agent core may publish an event notification on an Agent→UI channel of a message bus (e.g., topic 202 in bus 200 of FIG. 2).

Figure 4:
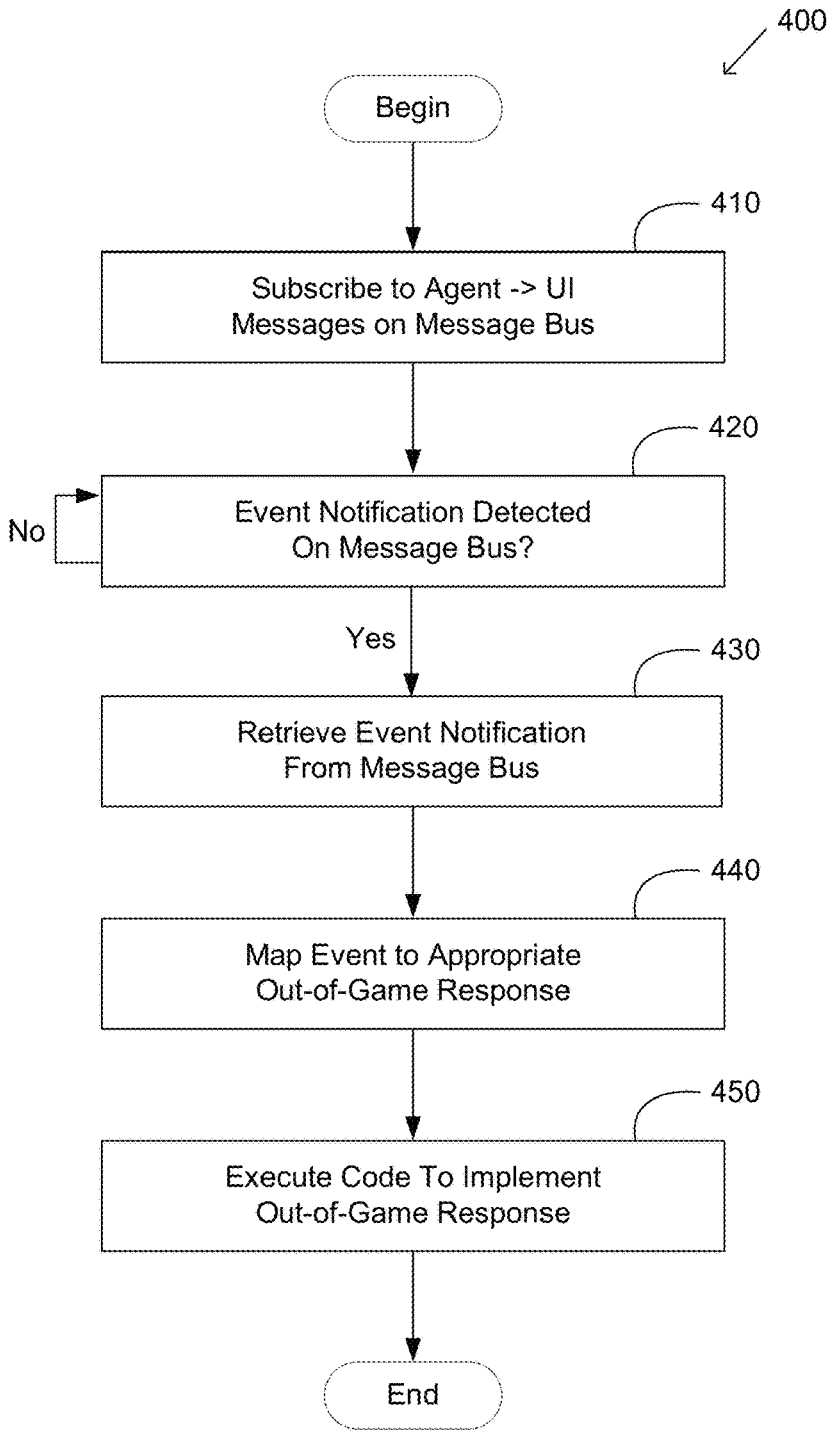
FIG. 4 illustrates an exemplary algorithm for implementing an out-of-game response based on a reported in-game event in accordance with some embodiments.

FIG. 4 illustrates a non-limiting exemplary algorithm 400 suitable for a set of front-end software functions to implement an out-of-game response based on a reported in-game event. At act 410, the front-end may subscribe to Agent→UI messages on a message bus (e.g., topic 202 in bus 200 of FIG. 2). At act 420, the front-end may make a determination whether an event notification from the events agent core is detected on the message bus. Act 420 may loop while no event notification is detected, and then may proceed to act 430 when an event notification is detected on the message bus. At act 430, the detected event notification from the events agent core may be retrieved from the message bus. At act 440, the front-end may map the received event to an out-of-game response appropriate for that event (e.g., in a look-up table maintained by the front-end). At act 450, the front-end may execute software code (e.g., via the one or more processors of the client device) to implement the out-of-game response identified as the appropriate response to the received event.

Figure 5:
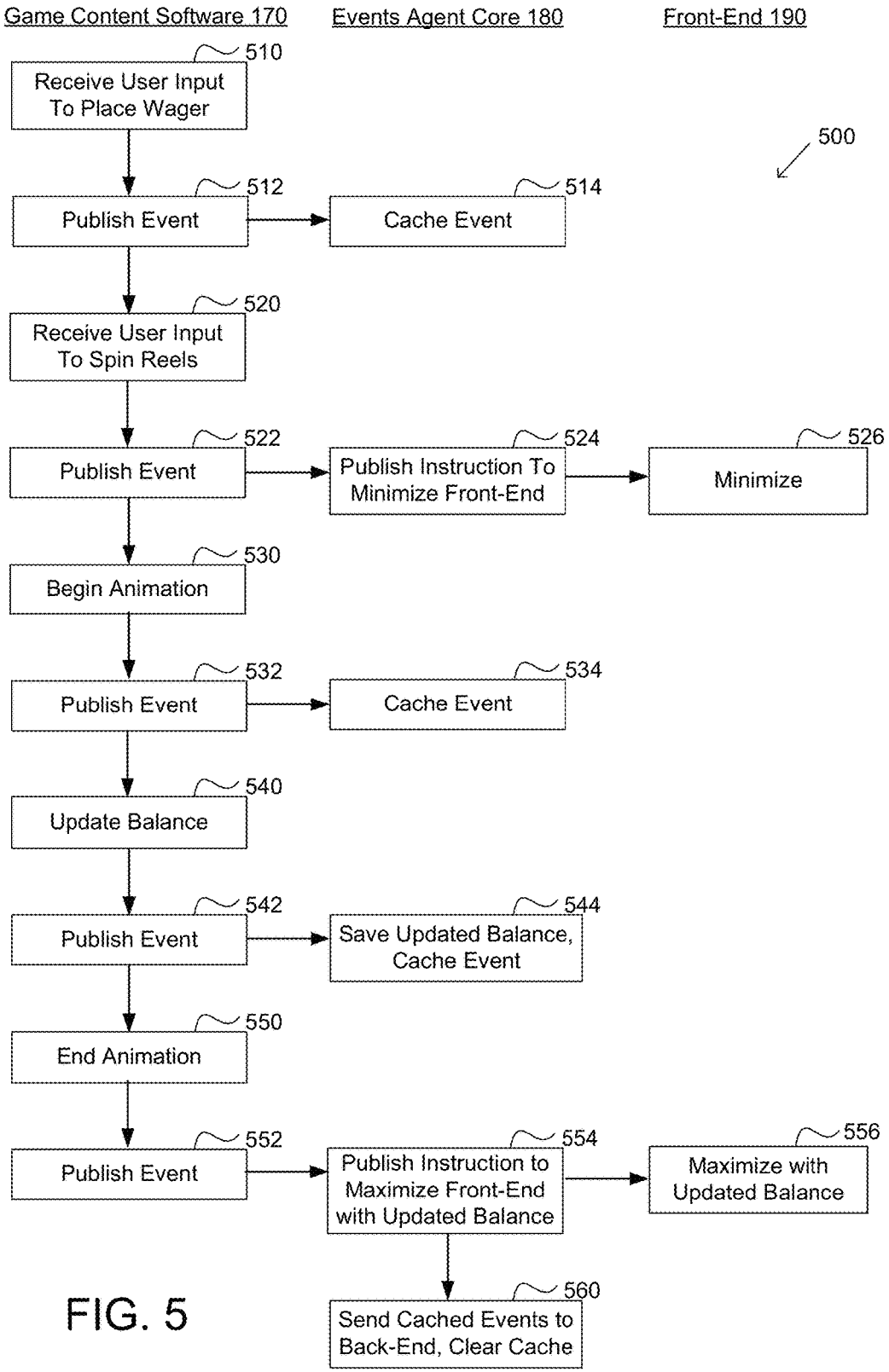
FIG. 5 illustrates an exemplary method for handling events in a reel-spinning game in accordance with some embodiments.

As discussed above, techniques described herein may be used in connection with any suitable wagering game that may be implemented in the form of game content software 170 downloaded to a client device 110. As a particular example, FIG. 5 illustrates an exemplary method 500 for handling events in a reel-spinning (e.g., electronic slot machine) game, in accordance with some embodiments. Exemplary method 500 is performed by and between game content software 170, events agent core 180, and front-end 190 downloaded to and executed on client device 110 (e.g., by a web browser on a player's personal computer or other computing device, by processing components of a casino game machine, or any other suitable client device). In a typical electronic reel-spinning game, the player enters a command to place a wager (e.g., by pressing a "bet" button), and then enters a command to spin the virtual reels of the electronic reel-spinning game (e.g., by pressing a "spin" button). The game content software then executes code to display an animation of the virtual reels spinning, with the symbols on the reels in the display becoming blurred as if they were spinning through the window of the display at speed. As the animation ends, the virtual reels slow and stop spinning with some combination of symbols (determined by random number generation) coming to rest on the payline, from which is determined whether any payout is won. Concurrently with processing the animation, the game content software updates the balance of the player's in-game account to deduct the amount of the wager and to add any winnings from the reel-spin payout.

Accordingly, method 500 begins at act 510 at which game content software 170 may receive user input to place a wager. Game content software 170 may then publish an event notification at act 512 indicating the current state of the game (e.g., that a wager of a particular amount has just been placed). The event notification may be published in a format and/or on a channel to which events agent core 180 subscribes, such that events agent core 180 may receive the event notification. Events agent core 180 may, each time an event notification is received, execute logic to determine the appropriate handling for the particular type of event notification received (e.g., via look-up table, rule set, or any other suitable form of logic). In this particular case, the notification of the wager event may not be of immediate interest to any other components, and the appropriate handling may be for events agent core 180 to cache the event at act 514.

Figure 8:
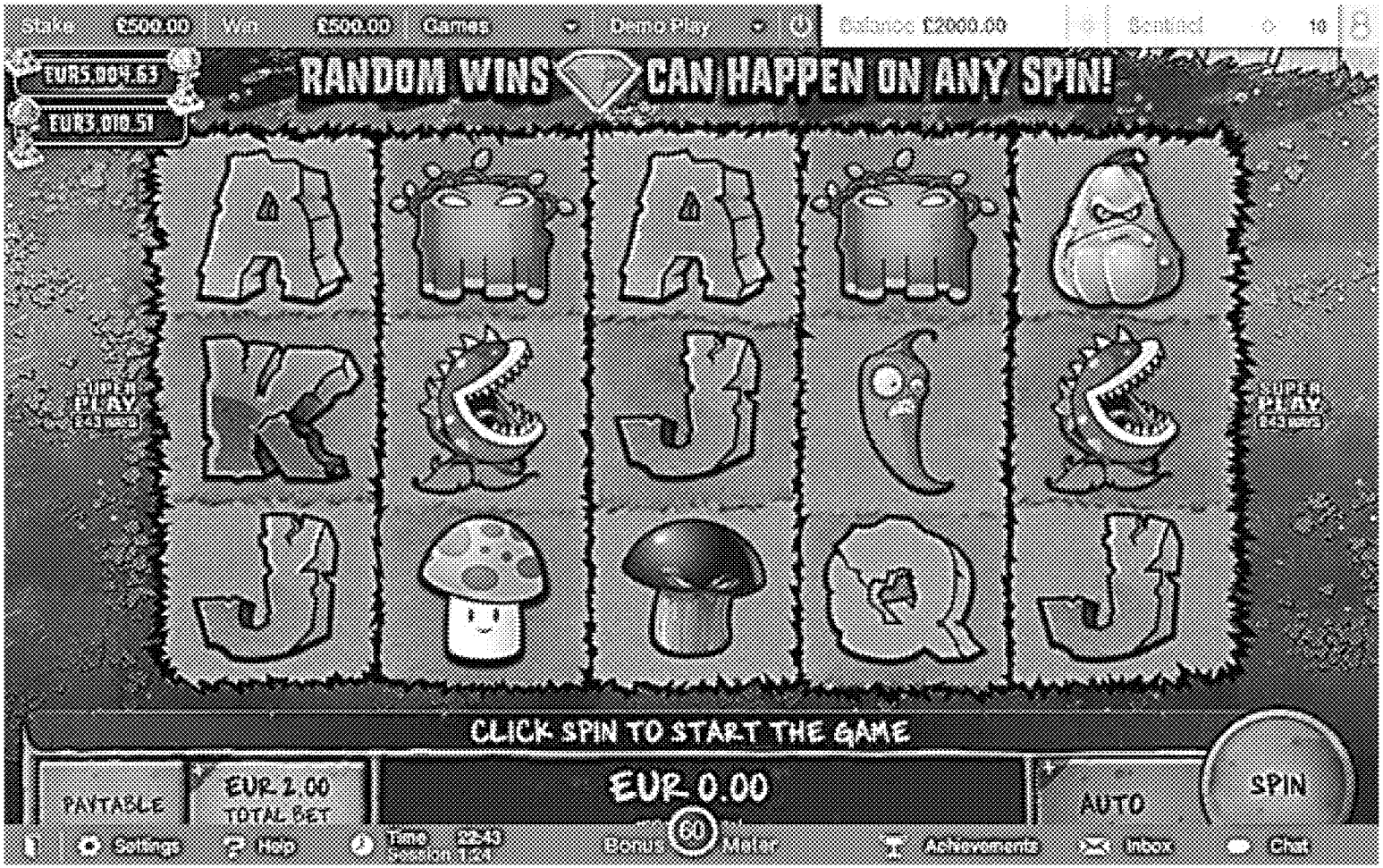
FIG. 8 illustrates an exemplary front-end and game content display in accordance with some embodiments.

At act 520, game content software 170 may receive user input to spin the virtual reels of the reel-spinning game. Game content software 170 may then publish an event notification at act 522 indicating the current state of the game (e.g., that a reel spin has just been initiated). At act 524, upon receipt of the event notification, events agent core 180 may determine the appropriate handling, which in this case may be to publish an instruction to the front-end to minimize its display. In some embodiments, the front-end software may display information to the player in a manner that at least partially overlaps, compresses, or otherwise obscures the game content software's display of the game itself, such as in one or more banners or panels that occupy some real estate on the display screen of the client device. FIG. 8, for example, illustrates an exemplary implementation in which the front-end operator-supplied information is displayed in a banner across the top of the screen and a banner across the bottom of the screen. In some such embodiments, the front-end display may be docked or minimized by moving it to another location on the display screen and/or making it smaller, or removing it entirely, when it is determined based on in-game event notifications that the game is currently in a state in which overlapping display of front-end information that obscures the game content is less desirable. An example of such a game state may be an animation, such as a reel-spin animation, during which it may not be desirable to obscure the graphics with extraneous information display. Accordingly, at act 524 of exemplary method 500, in response to the event notification that game content software 170 is beginning an animation state, events agent core 180 may publish an instruction to front-end 190, in response to which front-end 190 may minimize its display at act 526.

At act 530, game content software 170 may begin the reel-spinning animation, and may publish an event notification indicating the current game state at act 532. Events agent core 180 may receive the event notification and cache the event at act 534. At act 540, while the animation is processing, game content software 170 may update the player's in-game account balance data, and may publish an event notification indicating this update at act 542. Events agent core 180 may receive the event notification, save the indicated updated balance, and cache the event at act 544. At act 550, game content software 170 may complete the animation sequence, and may publish an event notification indicating the current game state (e.g., animation completed) at act 552. At act 554, in response to the event notification, events agent core 180 may publish an instruction to front-end 190 to maximize its display and update the display info with the player's updated current account balance. Front-end 190 may receive the published instruction event from events agent core 180 and maximize its display reflecting the updated balance at act 556. In some embodiments, the re-maximizing of the front-end display at act 556 may only be performed if the front-end display was maximized prior to the animation sequence. For example, in some embodiments, the player may have exercised an option or setting to minimize or dock the front-end display independently of the game state such as any animation, in which case the user-selected option may remain in effect and the front-end display may not be automatically maximized at the end of an animation sequence.

At act 560 of exemplary method 500, events agent core 180 may collect the events cached previously, and send the collected events to back-end analysis server 130, after which events agent core 180 may clear its events cache. Back-end analysis server 130 may utilize the collected events for aggregation and/or data analysis, examples of which are described above.

In some embodiments, control of one or more settings or options may be distributed between game content software 170 and front-end 190, as communicatively connected by events agent core 180, in any suitable way. For example, in some embodiments, one or more settings may be configured as in-game settings controlled by game content software 170, but a user may additionally be enabled to input commands to front-end 190 to configure those settings. Alternatively or additionally, in some embodiments, one or more settings may be configured as out-of-game settings controlled by front-end 190, but a user may additionally be enabled to input commands to game content software 170 to configure those settings. Some non-limiting examples of settings that may be suitable for configuration in this manner include sound settings (e.g., volume), turbo settings, graphics quality settings (e.g., color, brightness, etc.), help settings, paytable settings, etc.

Figure 6A:
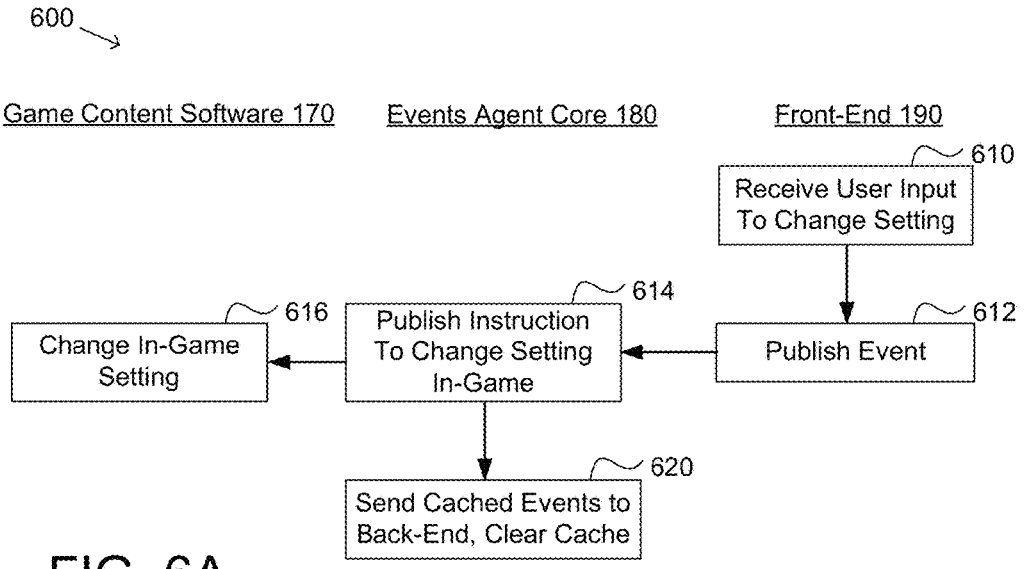
FIG. 6A illustrates an exemplary method for front-end driven setting change in accordance with some embodiments.

FIG. 6A illustrates an exemplary method 600 for using front-end 190 to control an in-game setting, in accordance with some embodiments. At act 610, front-end 190 may receive user input to change an in-game setting. In response, at act 612, front-end 190 may publish an event (e.g., on UI→Agent topic 210 in bus 200 of FIG. 2) indicating the receipt of the user input. At act 614, events agent core 180 may receive the published event and, in response, may publish an instruction (e.g., on Agent→Game topic 204 in bus 200 of FIG. 2) to change the setting in-game in accordance with the user command. At act 616, game content software 170 may receive the published event from events agent core 180 and, in response, may change the in-game setting accordingly. At act 620, events agent core 180 may send its cached events to back-end analysis server 130 for aggregation, and may clear its cache.

Figure 6B:
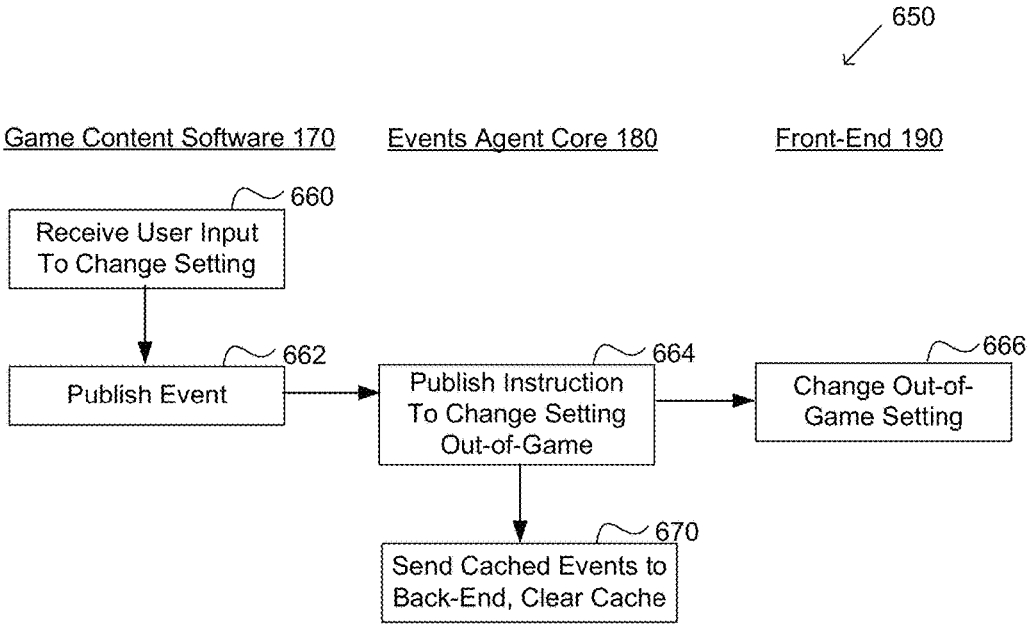
FIG. 6B illustrates an exemplary method for game-driven setting change in accordance with some embodiments.

FIG. 6B illustrates an exemplary method 650 for using game content software 170 to control an out-of-game setting, in accordance with some embodiments. At act 660, game content software 170 may receive user input to change an out-of-game setting. In response, at act 662, game content software 170 may publish an event (e.g., on Game→Agent topic 212 in bus 200 of FIG. 2) indicating the receipt of the user input. At act 664, events agent core 180 may receive the published event and, in response, may publish an instruction (e.g., on Agent→UI topic 202 in bus 200 of FIG. 2) to change the setting out-of-game in accordance with the user command. At act 666, front-end 190 may receive the published event from events agent core 180 and, in response, may change the out-of-game setting accordingly. At act 670, events agent core 180 may send its cached events to back-end analysis server 130 for aggregation, and may clear its cache.

Figure 7:
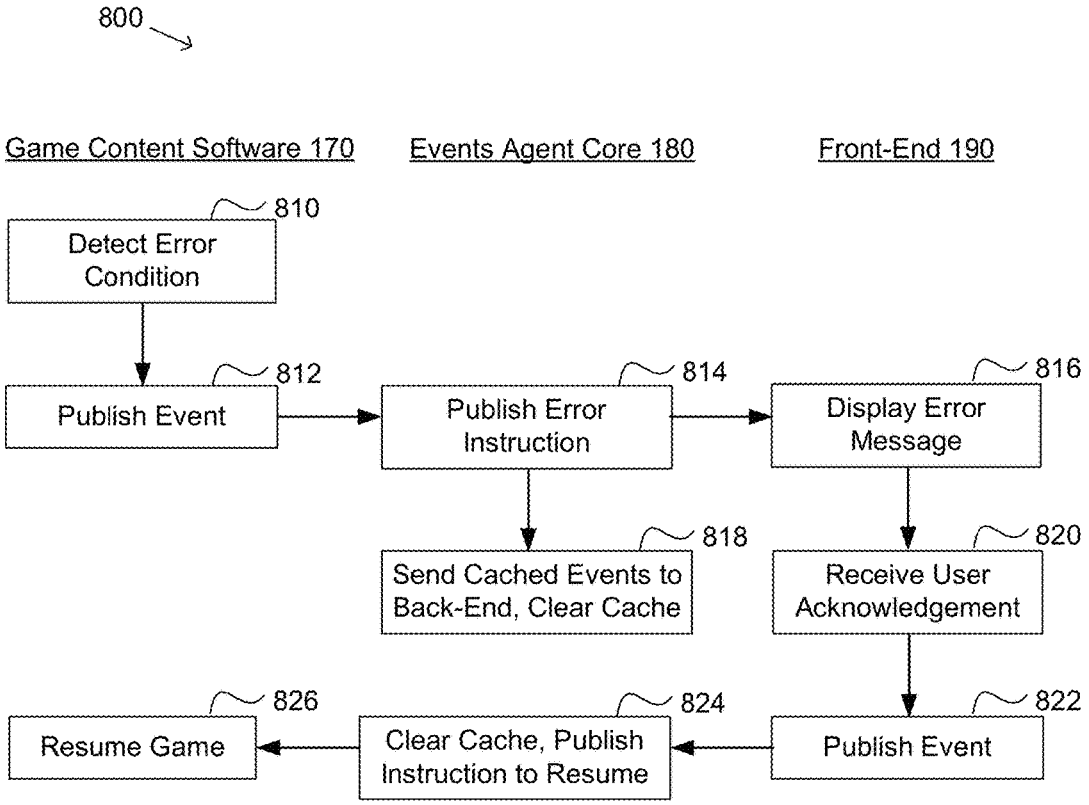
FIG. 7 illustrates an exemplary method for error handling in accordance with some embodiments.

In some embodiments, when an error condition occurs in a wagering game executing via game content software (e.g., an error in the execution of the software on the client device, or an error in transmission of software instructions and/or data from the game supplier server), an error notification may be displayed to the user via front-end 190 in a manner that is consistent across different games, e.g., to aid the user in quickly recognizing and understanding the error. FIG. 7 illustrates an exemplary method 800 for handling such errors in accordance with some embodiments. At act 810, game content software 170 may detect an error condition, e.g., in its own execution, in its connection with game supplier server 140, etc. At act 812, game content software 170 may publish an event (e.g., on Game→Agent topic 212 in bus 200 of FIG. 2) indicating the detected error condition. At act 814, events agent core 180 may receive the published event and, in response, may publish a corresponding instruction (e.g., on Agent→UI topic 202 in bus 200 of FIG. 2) to front-end 190. Meanwhile, events agent core 180 may send its cached events to back-end analysis server 130 at act 818 for aggregation and/or analysis. Front-end 190 may receive the published instruction from events agent core 180 and may display a suitable error message to the user at act 816. Front-end 190 may then receive an acknowledgment from the user at act 820, and may publish an event (e.g., on UI→Agent topic 210 in bus 200 of FIG. 2) indicating the receipt of the user acknowledgement at act 822. In response, events agent core 180 may clear its cache and publish an instruction at act 824 to game content software 170 (e.g., on Agent→Game topic 204 in bus 200 of FIG. 2) to resume the game if possible. At act 826, game content software 170 may receive the published instruction from events agent core 180 and may clear the error condition and resume execution of the wagering game. Alternatively, if the error is non-recoverable, in some cases the player may be redirected to restart the game or select a different game to play.

The table below provides an exemplary list of suitable messages that may be communicated between components executing on client device 110; however, it should be appreciated that this list is merely an example. Some embodiments may utilize only some or none of the message types in this exemplary list, and/or may utilize additional message types not appearing in the list below.

| Topic | Message | Details |
|---|---|---|
| UI -> Agent | Logout | Logout active user. |
| | Toggle UI | Toggle UI between minimized and maximized. |
| | Enable/Disable Sound | Enable/disable game sound from UI. |
| | Enable/Disable Turbo | Enable/disable game turbo from UI. |
| | Toggle Graphic | Toggle game graphic. |
| | Generic Event | Used to trace an event that does not fall into a specific category. |
| | Message Ack | Player closes message box. |
| Agent -> UI | Player Account Info | Share player account information with UI. |
| | Loading Update | Inform UI of the percent loaded. |
| | Loading Complete | Inform UI that the loading phase has completed. |
| | Update Balance | Instruct UI to update balance with new value. |
| | Init | Share init parameters. |
| | Display Error | Display error message to user. |
| | Display Message from Communication Module | Communication Module sends message to be displayed via the front-end UI. |
| | Display Message | Display message via front-end UI. |
| | UI Minimized Position | Provide configuration about where to place the button to maximize the UI. |
| | UI State | Minimize or maximize the UI. |
| | UI Enable/Disable | Enable/disable player clicks/touches on the UI. |
| | UI Restore | Restore the previous state of the UI as saved in the events agent core. |
| | Enable/Disable Sound | Enable/disable game sound from game content software. |
| | Enable/Disable Turbo | Enable/disable game turbo from game content software. |
| | Toggle Graphic | Toggle game graphic. |
| | Force Closure of Message Box | Force closure of a message box. |
| | Set Currency | Set currency. |
| Game -> Agent | Init | Initial parameters to register game features. |
| | Update Balance | Update player balance. |
| | Start Animation | Start animation and take control of UI. |
| | Stop Animation | Animation finished. |
| | Disable Sound | Player clicked on mute button. |
| | Enable Sound | Player clicked on enable sound. |
| | Disable Turbo | Player clicked on disable turbo mode. |
| | Enable Turbo | Player clicked on enable turbo mode. |
| | Change Graphic | Player clicked on change graphic option. |
| | Error Handling | Display error to user. |
| | Message Handling | Display message to user. |
| | Generic Event | Trace a generic event. |
| | Jackpot Messages | Trace a jackpot event. |
| Agent -> Game | Disable Sound | Mute sound pressed on UI. |
| | Enable Sound | Enable sound pressed on UI. |
| | Disable Turbo | Turbo off pressed on UI. |
| | Enable Turbo | Turbo on pressed on UI. |
| | Change Graphic | Change graphic mode pressed on UI. |

As mentioned above, FIG. 8 provides an illustration of an exemplary implementation of a front-end display, in accordance with some embodiments. This particular example provides the player (user) with access to the following functions via the UI provided by the front-end. It should be appreciated, however that this list is merely an example. Some embodiments may utilize only some or none of the front-end UI functions in this exemplary list, and/or may utilize additional front-end UI function types not appearing in the list below.

Figure 9:
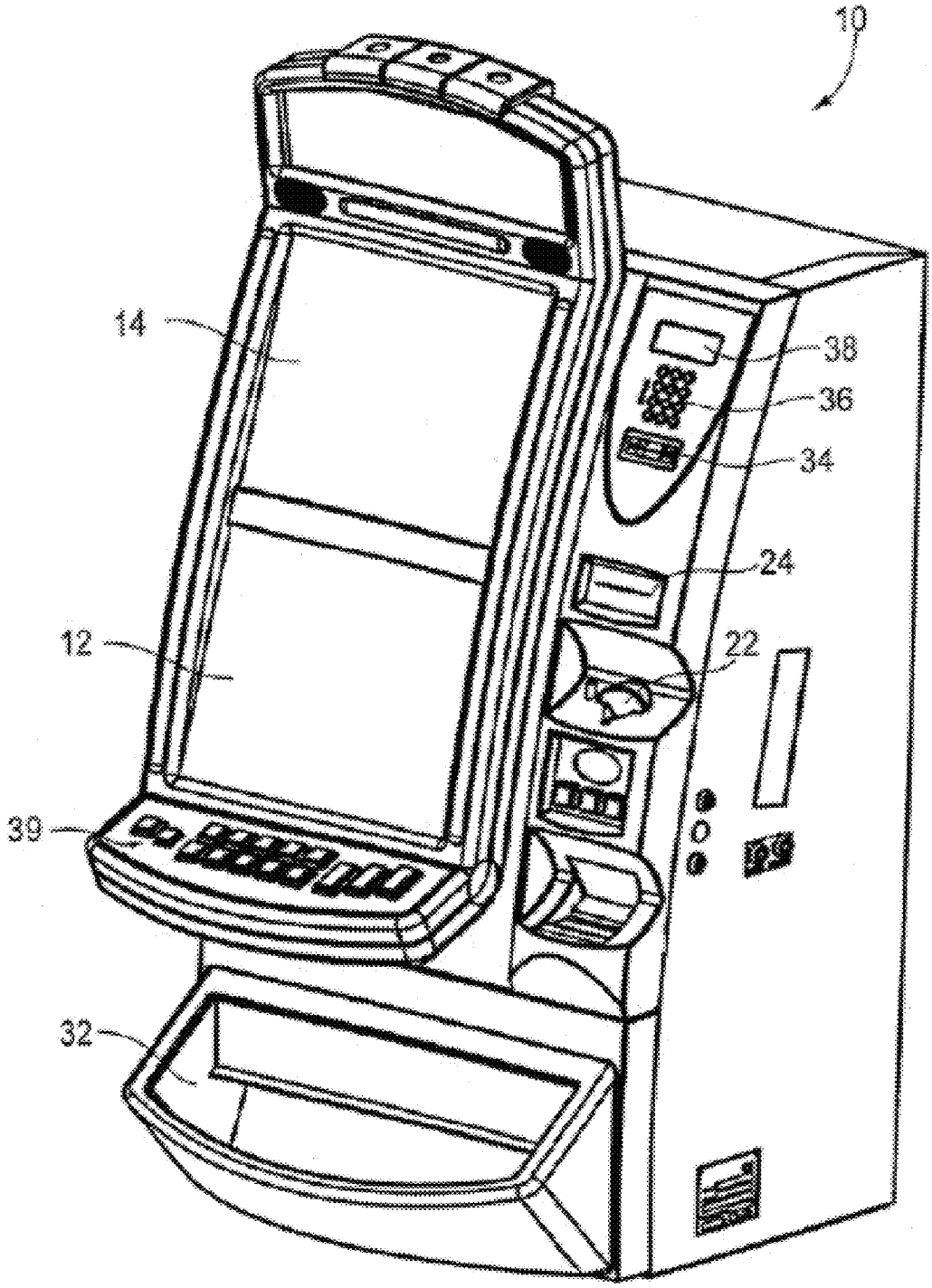
FIG. 9 illustrates an exemplary casino game machine in accordance with some embodiments.

Exemplary UI Functions
Minimize/Maximize
Balance
Stake
Win
Game List
Game Thumbnails
Settings
Settings→Mute
Settings→Turbo
Settings→Graphics
Help
Help→Paytable
Help→About
Deposit
Play for Real/Play for Fun/Demo
Login
User Profile
User Profile→Logout
Time/Session Timer
Back to Lobby
Inbox icon (with counter)
Notifications icons
Ads/promo box
Chat
Chat→Status Bonus Meter
Achievements
Achievements→List of achievements
Levels
XP
Popup/Message Box—information
Popup/Message Box—error
Game Load—Progress Bar As discussed above, some embodiments may implement techniques described herein in a brick-and-mortar casino environment, in which client device 110 may be a casino game machine such as an electronic gaming machine (e.g., slot machine). An exemplary cabinet 10 housing a casino game machine is illustrated in perspective view in FIG. 9. Exemplary cabinet 10, as depicted in FIG. 9, includes a display 12 that may be a thin film transistor (TFT) display, a liquid crystal display (LCD), a cathode ray tube (CRT) display, a light-emitting diode (LED) display, an organic LED (OLED) display, an autostereoscopic three dimensional (3D) display, or any other type of display. A second display 14 may provide game data or other information in addition to display 12. Display 14 may provide static information, such as an advertisement for the game, the rules of the game, pay tables, pay lines, and/or other information, and/or may even display the main game or a bonus game along with display 12. Alternatively, the area for display 14 may be a display glass for conveying information about the game. Display 12 may also include a camera for use, for example, in presenting an autostereoscopic 3D display.

Display 12 and/or display 14 may have a touch screen lamination that includes a transparent grid of conductors. A player touching the screen may change the capacitance between the conductors, and thereby the X-Y location of the touch on the screen may be determined. A processor within cabinet 10 may associate this X-Y location with a function to be performed. There may be an upper and lower multi-touch screen in accordance with some embodiments.

A coin slot 22 may accept coins or tokens in one or more denominations to generate credits within the casino game machine for playing games. An input slot 24 for an optical reader and printer may receive machine readable printed tickets and may output printed tickets for use in cashless gaming.

A coin tray 32 may receive coins or tokens from a hopper (not shown) upon a win or upon the player cashing out. However, in some embodiments, the casino game machine may not pay in cash, but may only issue a printed ticket for cashing in elsewhere. Alternatively, a stored value card may be loaded with credits based on a win, or may enable the assignment of credits to an account associated with a computer system, which may be a computer network-connected computer.

A card reader slot 34 may accept any of various types of cards, such as smart cards, magnetic strip cards, and/or other types of cards conveying machine readable information. The card reader may read the inserted card for player and/or credit information for cashless gaming. The card reader may read a magnetic code on a conventional player tracking card, where the code uniquely identifies the player to the host system. The code may be cross-referenced by the host system to any data related to the player, and such data may affect the games offered to the player by the casino game machine. The card reader may also include an optical reader and printer for reading and printing coded barcodes and other information on a paper ticket. A card may also include credentials that enable the host system to access one or more accounts associated with a user. The account may be debited based on wagers by a user and credited based on a win.

A keypad 36 may accept player input, such as a personal identification number (PIN) and/or any other player information. A display 38 above keypad 36 may display a menu for instructions and/or other information, and/or may provide visual feedback of the keys pressed. The keypad 36 may be an input device such as a touchscreen, or dynamic digital button panel, in accordance with some embodiments.

Player control buttons 39 may include any buttons and/or other controllers usable for the play of the particular game or games offered by the casino game machine, including, for example, a bet button, a repeat bet button, a spin reels (or play) button, a maximum bet button, a cash-out button, a display pay lines button, a display payout tables button, select icon buttons, and/or any other suitable button(s). In some embodiments, buttons 39 may be replaced by a touch screen with virtual buttons. In some embodiments, touchless control gesture functionality discussed below may replace or coexist with buttons 39.

Figure 10:
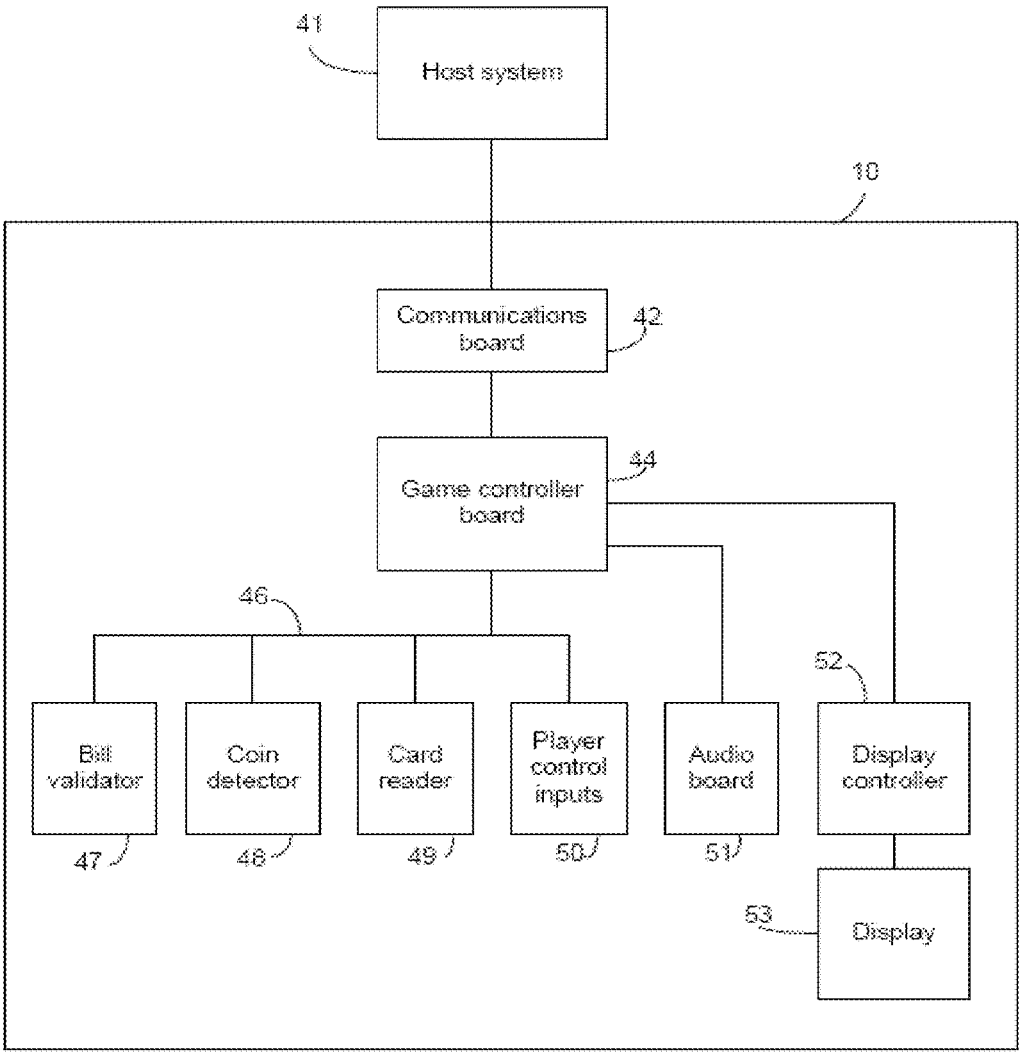
FIG. 10 illustrates a casino game machine linked to a casino's host system in accordance with some embodiments.

FIG. 10 is a block diagram of an exemplary casino game machine 10 linked to a casino's host system 41. In the example shown, a communications board 42 may contain circuitry for coupling the casino game machine 10 to a local area network (LAN) and/or other type of network using any suitable protocol, such as the G2S protocols. Internet protocols are typically used for such communication under the G2S standard, incorporated herein by reference. Communications board 42 may transmit using a wireless transmitter, and/or may be directly connected to a network running throughout the casino floor. Communications board 42 may set up a communication link with a master controller and may buffer data between the network and game controller board 44. Communications board 42 may also communicate with a network server, such as in accordance with the G2S standard, for exchanging information to carry out embodiments described herein.

Game controller board 44 may contain memory and one or more processors for carrying out programs stored in the memory and for providing the information requested by the network. Game controller board 44 may execute programs stored in the memory and/or instructions received from host system 41 to carry out game routines.

Peripheral devices/boards may communicate with game controller board 44 via a bus 46 using, for example, an RS-232 interface. Such peripherals may include a bill validator 47, a coin detector 48, a smart card reader and/or other type of credit card reader 49, and/or player control inputs 50 (such as buttons 39 and/or a touch screen).

Game controller board 44 may also control one or more devices that produce the game output including audio and video output associated with a particular game that is presented to the user. For example, audio board 51 may convert coded signals into analog signals for driving speakers. Display controller 52 may convert coded signals into pixel signals for one or more displays 53 (e.g., display 12 and/or display 14). Display controller 52 and audio board 51 may be directly connected to parallel ports on game controller board 44. In some embodiments, the electronics on the various boards may be combined in any suitable way, such as onto a single board.

Figure 11:
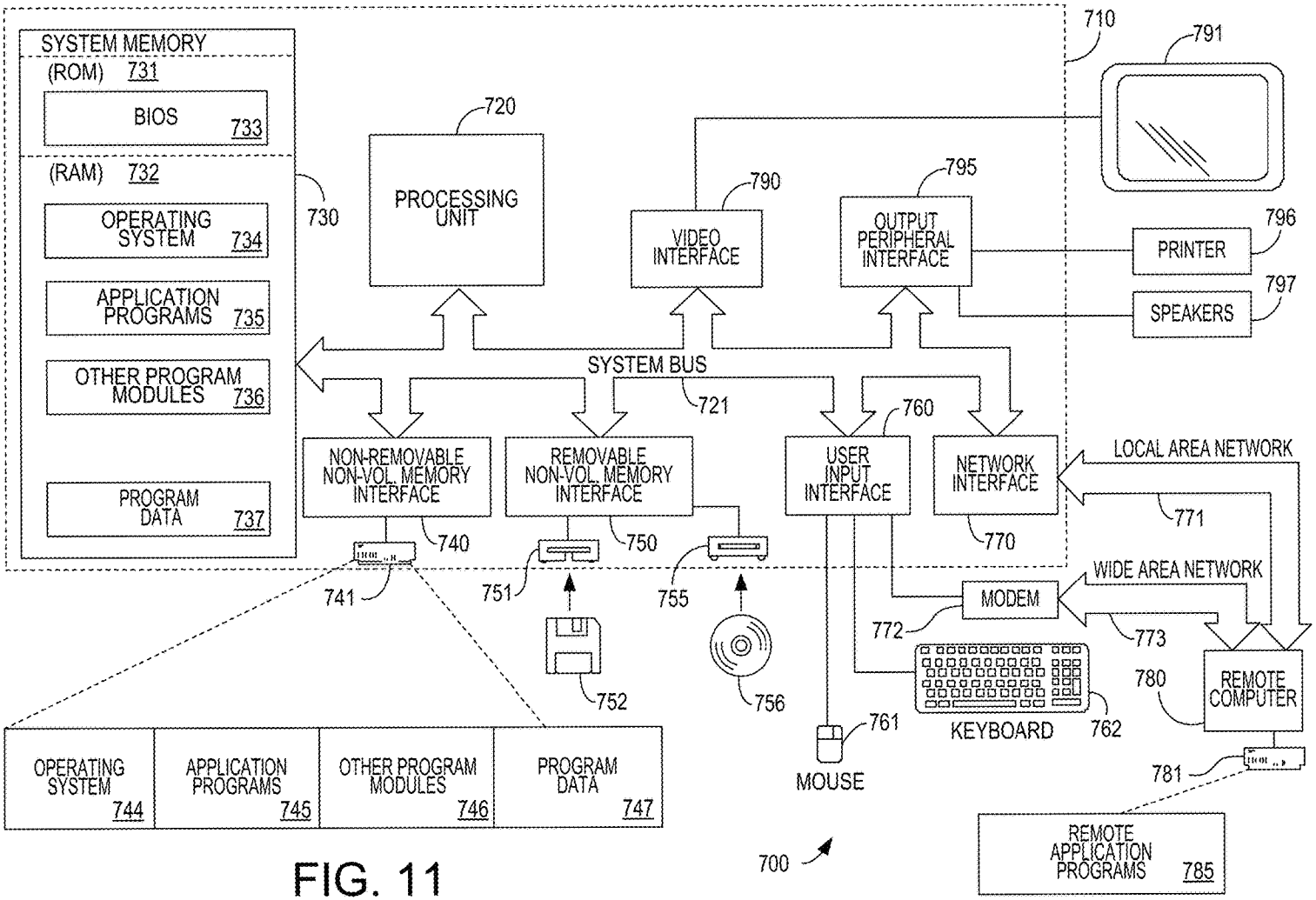
FIG. 11 illustrates an exemplary computing environment in which some embodiments may be implemented.

FIG. 11 illustrates an example of a suitable computing system environment 700 in which some embodiments may be implemented. This computing system may be representative of a computing system that allows a suitable control system to implement the described techniques. However, it should be appreciated that the computing system environment 700 is only one example of a suitable computing environment and is not intended to suggest any limitation as to the scope of use or functionality of the described embodiments. Neither should the computing environment 700 be interpreted as having any dependency or requirement relating to any one or combination of components illustrated in the exemplary operating environment 700.

The embodiments are operational with numerous other general purpose or special purpose computing system environments or configurations. Examples of well-known computing systems, environments, and/or configurations that may be suitable for use with the described techniques include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

The computing environment may execute computer-executable instructions, such as program modules. Generally, program modules include routines, programs, objects, components, data structures, etc., that perform particular tasks or implement particular abstract data types. The embodiments may also be practiced in distributed computing environments where tasks are performed by remote processing devices that are linked through a communications network. In a distributed computing environment, program modules may be located in both local and remote computer storage media including memory storage devices.

With reference to FIG. 11, an exemplary system for implementing the described techniques includes a general purpose computing device in the form of a computer 710. Components of computer 710 may include, but are not limited to, a processing unit 720, a system memory 730, and a system bus 721 that couples various system components including the system memory to the processing unit 720. The system bus 721 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 710 typically includes a variety of computer readable media. Computer readable media can be any available media that can be accessed by computer 710 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can accessed by computer 710. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer readable media.

The system memory 730 includes computer storage media in the form of volatile and/or nonvolatile memory such as read only memory (ROM) 731 and random access memory (RAM) 732. A basic input/output system 733 (BIOS), containing the basic routines that help to transfer information between elements within computer 710, such as during start-up, is typically stored in ROM 731. RAM 732 typically contains data and/or program modules that are immediately accessible to and/or presently being operated on by processing unit 720. By way of example, and not limitation, FIG. 11 illustrates operating system 734, application programs 735, other program modules 736, and program data 737.

The computer 710 may also include other removable/non-removable, volatile/nonvolatile computer storage media. By way of example only, FIG. 11 illustrates a hard disk drive 741 that reads from or writes to non-removable, nonvolatile magnetic media, a magnetic disk drive 751 that reads from or writes to a removable, nonvolatile magnetic disk 752, and an optical disk drive 755 that reads from or writes to a removable, nonvolatile optical disk 756 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 741 is typically connected to the system bus 721 through a non-removable memory interface such as interface 740, and magnetic disk drive 751 and optical disk drive 755 are typically connected to the system bus 721 by a removable memory interface, such as interface 750.

The drives and their associated computer storage media discussed above and illustrated in FIG. 11 provide storage of computer readable instructions, data structures, program modules and other data for the computer 710. In FIG. 11, for example, hard disk drive 741 is illustrated as storing operating system 744, application programs 745, other program modules 746, and program data 747. Note that these components can either be the same as or different from operating system 734, application programs 735, other program modules 736, and program data 737. Operating system 744, application programs 745, other program modules 746, and program data 747 are given different numbers here to illustrate that, at a minimum, they are different copies. A user may enter commands and information into the computer 710 through input devices such as a keyboard 762 and pointing device 761, commonly referred to as a mouse, trackball or touch pad. Other input devices (not shown) may include a microphone, joystick, game pad, satellite dish, scanner, touchscreen, or the like. These and other input devices are often connected to the processing unit 720 through a user input interface 760 that is coupled to the system bus, but may be connected by other interface and bus structures, such as a parallel port, game port or a universal serial bus (USB). A monitor 791 or other type of display device is also connected to the system bus 721 via an interface, such as a video interface 790. In addition to the monitor, computers may also include other peripheral output devices such as speakers 797 and printer 796, which may be connected through an output peripheral interface 795.

The computer 710 may operate in a networked environment using logical connections to one or more remote computers, such as a remote computer 780. The remote computer 780 may be a personal computer, a server, a router, a network PC, a peer device or other common network node, and typically includes many or all of the elements described above relative to the computer 710, although only a memory storage device 781 has been illustrated in FIG. 11. The logical connections depicted in FIG. 11 include a local area network (LAN) 771 and a wide area network (WAN) 773, but may also include other networks. Such networking environments are commonplace in offices, enterprise-wide computer networks, intranets and the Internet.

When used in a LAN networking environment, the computer 710 is connected to the LAN 771 through a network interface or adapter 770. When used in a WAN networking environment, the computer 710 typically includes a modem 772 or other means for establishing communications over the WAN 773, such as the Internet. The modem 772, which may be internal or external, may be connected to the system bus 721 via the user input interface 760, or other appropriate mechanism. In a networked environment, program modules depicted relative to the computer 710, or portions thereof, may be stored in the remote memory storage device. By way of example, and not limitation, FIG. 11 illustrates remote application programs 785 as residing on memory device 781. It will be appreciated that the network connections shown are exemplary and other means of establishing a communications link between the computers may be used.

The above-described embodiments can be implemented in any of numerous ways. For example, the embodiments may be implemented using hardware, software or a combination thereof. When implemented in software, the software code can be executed on any suitable processor or collection of processors, whether provided in a single computer or distributed among multiple computers. It should be appreciated that any component or collection of components that perform the functions described above can be generically considered as one or more controllers that control the above-discussed functions. The one or more controllers can be implemented in numerous ways, such as with dedicated hardware, or with general purpose hardware (e.g., one or more processors) that is programmed using microcode or software to perform the functions recited above.

In this respect, it should be appreciated that one implementation comprises at least one processor-readable storage medium (i.e., at least one tangible, non-transitory processor-readable medium, e.g., a computer memory (e.g., hard drive, flash memory, processor working memory, etc.), a floppy disk, an optical disc, a magnetic tape, or other tangible, non-transitory processor-readable medium) encoded with a computer program (i.e., a plurality of instructions), which, when executed on one or more processors, performs at least some of the above-discussed functions, and possibly others. The processor-readable storage medium can be transportable such that the program stored thereon can be loaded onto any computer resource to implement functionality discussed herein. In addition, it should be appreciated that the reference to a computer program which, when executed, performs above-discussed functions, is not limited to an application program running on a host computer. Rather, the term "computer program" is used herein in a generic sense to reference any type of computer code (e.g., software or microcode) that can be employed to program one or more processors to implement above-discussed functionality.

The phraseology and terminology used herein is for the purpose of description and should not be regarded as limiting. The use of "including," "comprising," "having," "containing," "involving," and variations thereof, is meant to encompass the items listed thereafter and additional items. Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Having described several embodiments of the invention in detail, various modifications and improvements will readily occur to those skilled in the art. Such modifications and improvements are intended to be within the spirit and scope of the invention. Accordingly, the foregoing description is by way of example only, and is not intended as limiting. The invention is limited only as defined by the following claims and the equivalents thereto.

What is claimed is:

1. A wagering gaming system comprising:

a back-end events analysis server; and a wagering gaming operator server, different from the back-end events analysis server, configured to:

receive from a client device a request for game content software to provide wagering game play to a user of the client device;

in response to the request, enable the client device to download the requested game content software from a game supplier server that is different from the wagering gaming operator server; and transmit to the client device, from the wagering gaming operator server, an events agent core library of software functions and a set of front-end software functions;

wherein the events agent core library, when executed by the client device, performs functionality comprising:

receiving, from the downloaded game content software executing on the client device, notifications during a wagering game of in-game events of the wagering game being executed by the downloaded game content software executing on the client device; and based on the notifications, reporting at least some of the in-game events to the front-end software functions, and reporting at least some of the in-game events to the back-end analysis server, wherein the events agent core library is configured to report events to the set of front-end software functions within the client device, the game content software within the client device and the back-end analysis server that is external to the client device by publishing events through routing logic to a bus within the events agent core library to which the set of front-end software functions, the game content software and the back-end analysis server are subscribed;

wherein the front-end software functions, when executed by the client device, perform functionality comprising implementing an out-of-game response based on at least one of the reported in-game events;

wherein the back-end events analysis server is configured to:

aggregate the reported in-game events from a plurality of wagering games at the back-end events analysis server; and provide to the game supplier server, from the back-end events analysis server, analytics based on the aggregated in-game events;

and wherein the client device is configured to receive updated game content software from the game supplier server in response to the analytics from the back-end events analysis server.

2. At least one non-transitory processor-readable storage medium storing processor-executable instructions that, when executed by at least one processor of a client device, perform functionality comprising:

receiving, at an events agent core within the client device from game content software, notifications during a wagering game of in-game events of the wagering game from the game content software downloaded to the client device from a game supplier server and executing on the client device to provide the wagering game play to a user of the client device;

based on the notifications, reporting, from the events agent core within the client device, at least some of the in-game events to a front-end set of processor-executable instructions within the client device and downloaded to the client device from a gaming operator server different from the game supplier server, the front-end set of processor-executable instructions being configured to cause the at least one processor of the client device to implement an out-of-game response based on at least one of the reported in-game events; and based on the notifications, reporting, from the events agent core within the client device, at least some of the in-game events to a back-end analysis server that is different from the client device and different from the game supplier server;

wherein the events agent core is configured to report events to the front-end set of processor-executable instructions within the client device, the game content software within the client device and the back-end analysis server that is external to the client device by publishing events through routing logic to a bus within the events agent core to which the front-end software set of processor-executable instructions, the game content software and the back-end analysis server are subscribed.

3. The at least one non-transitory processor-readable storage medium of claim 2, wherein the notifications of in-game events comprise notification of a state of the wagering game being played by the user via execution of the game content software.

4. The at least one non-transitory processor-readable storage medium of claim 3, wherein the out-of-game response comprises prompting the user, based on the state of the wagering game, to take an action directed to a monetary account of the user that is established for funding game play in a plurality of wagering games.

5. The at least one non-transitory processor-readable storage medium of claim 4, wherein the notification of the state of the wagering game comprises notification that a bonus has been triggered in the wagering game, and wherein the out-of-game response comprises prompting the user to add funds to the monetary account.

6. The at least one non-transitory processor-readable storage medium of claim 2, wherein the out-of-game response comprises displaying to the user information derived from events notifications from a plurality of wagering games.

7. A wagering gaming operator server, comprising:

at least one processor; and at least one storage medium storing processor-executable instructions that, when executed by the at least one processor, cause the at least one processor to perform:

receiving, from a client device, a request for game content software to provide wagering game play to a user of the client device;

in response to the request, enabling the client device to download the requested game content software from a game supplier server different from the wagering gaming operator server; and transmitting to the client device, from the wagering gaming operator server, an events agent core library of software functions and a set of front-end software functions;

wherein the events agent core library, when executed by the client device, performs functionality comprising:

receiving, from the downloaded game content software executing on the client device, notifications during a wagering game of in-game events of the wagering game being executed by the downloaded game content software executing on the client device; and based on the notifications, reporting at least some of the in-game events to the front-end software functions, wherein the events agent core library is configured to report events to the front-end software functions within the client device, the game content software within the client device and a back-end analysis server that is external to the client device by publishing events through routing logic to a bus within the events agent core library to which the front-end software functions, the game content software and the back-end analysis server are subscribed;

and wherein the front-end software functions, when executed by the client device, perform functionality comprising implementing an out-of-game response based on at least one of the reported in-game events.

8. The wagering gaming operator server of claim 7, wherein the notifications of in-game events comprise notification of a state of the wagering game being played by the user via execution of the game content software.

9. The wagering gaming operator server of claim 8, wherein the out-of-game response comprises prompting the user, based on the state of the wagering game, to take an action directed to a monetary account of the user that is established for funding game play in a plurality of wagering games.

10. The wagering gaming operator server of claim 9, wherein the notification of the state of the wagering game comprises notification that a bonus has been triggered in the wagering game, and wherein the out-of-game response comprises prompting the user to add funds to the monetary account.

11. The wagering gaming operator server of claim 7, wherein the out-of-game response comprises displaying to the user information derived from events notifications from a plurality of wagering games.

12. A wagering gaming operator server, comprising:

at least one processor; and at least one storage medium storing processor-executable instructions that, when executed by the at least one processor, cause the at least one processor to perform:

receiving, from a client device, a request for game content software to provide wagering game play to a user of the client device;

in response to the request, enabling the client device to download the requested game content software from a game supplier server different from the wagering gaming operator server; and transmitting to the client device, from the wagering gaming operator server, an events agent core library of software functions that, when executed by the client device, performs functionality comprising:

receiving, from the downloaded game content software executing on the client device, notifications during a wagering game of in-game events of the wagering game being executed by the downloaded game content software executing on the client device; and based on the notifications, reporting at least some of the in-game events to a back-end analysis server, different from the game supplier server, that is configured to aggregate the reported in-game events from a plurality of wagering games, and provide analytics based on the aggregated in-game events to the game supplier server, wherein the game supplier server is configured to perform alterations on the game content software for transmission to the client device in response to the analytics;

wherein the events agent core library is configured to report events to the game content software within the client device and the back-end analysis server that is external to the client device by publishing events through routing logic to a bus within the events agent core library to which the game content software and the back-end analysis server are subscribed.

13. A method of facilitating feedback adaptation in a wagering gaming system, the method comprising:

providing a back-end events analysis server configured to communicate with a game supplier server that transmits game content software to a client device to provide wagering game play to a user of the client device;

providing to the client device, via a server different from the game supplier server, an events agent core library of software functions that, when executed by the client device, performs functionality comprising:

receiving, from the downloaded game content software executing on the client device, notifications during a wagering game of in-game events of the wagering game being executed by the downloaded game content software executing on the client device; and based on the notifications, reporting at least some of the in-game events to the back-end analysis server;

aggregating the reported in-game events from a plurality of wagering games at the back-end events analysis server; and providing to the game supplier server, from the back-end events analysis server, analytics based on the aggregated in-game events to enable the game supplier server to perform alterations on the game content software for transmission to the client device in response to the analytics from the back-end events analysis server;

wherein the events agent core library is configured to report events to the game content software within the client device and the back-end analysis server that is external to the client device by publishing events through routing logic to a bus within the events agent core to which the game content software and the back-end analysis server are subscribed.

14. The method of claim 13, wherein the game supplier server is configured to perform alterations on the game content software comprising configuring the game content software to trigger at least one in-game event based on the analytics provided from the back-end events analysis server.

15. The method of claim 13, wherein the game supplier server is configured to perform alterations on the game content software comprising modifying, based on the analytics provided from the back-end events analysis server, at least one probability used by the game content software in providing the wagering game play to the user.

* * * * *